United States Patent [19]

Laudig et al.

[11] Patent Number: 4,904,206

[45] Date of Patent: Feb. 27, 1990

[54] HIGH VOLTAGE COAXIAL CONNECTOR

[75] Inventors: Ronald C. Laudig, Mechanicsburg; George W. Michael, III, Harrisburg; Douglas M. Johnescu, York, all of Pa.

[73] Assignee: AMP Incorporated, Harrisburg, Pa.

[21] Appl. No.: 382,079

[22] Filed: Jul. 17, 1989

Related U.S. Application Data

[63] Continuation of Ser. No. 180,413, Apr. 12, 1988, abandoned.

[51] Int. Cl.[4] ..... H01R 17/18

[52] U.S. Cl. ..... 439/578; 439/311

[58] Field of Search ..... 439/578–585, 439/607–610, 98, 99, 675, 905, 906, 311

[56] References Cited

U.S. PATENT DOCUMENTS

| | | | |
|---|---|---|---|
| 2,762,025 | 9/1956 | Melcher | 439/580 |
| 3,141,924 | 7/1964 | Forney, Jr. . | |
| 4,008,941 | 2/1977 | Smith . | |
| 4,598,961 | 7/1986 | Cohen . | |
| 4,605,269 | 8/1986 | Cohen et al. | 439/63 |
| 4,659,156 | 4/1987 | Johnescu et al. | 439/63 |
| 4,674,809 | 6/1987 | Hollyday et al. | 439/580 |
| 4,749,355 | 7/1988 | Hemmer | 439/63 |

OTHER PUBLICATIONS

AMP Data Sheet #459-7, "Coaxial Cable Connector".

*Primary Examiner*—David Pirlot
*Attorney, Agent, or Firm*—Gerald K. Kita

[57] ABSTRACT

A coaxial connector (1) in which a conductive housing (2) is provided with a projecting electrical terminal (8), a conductive shell (3) and an insulative body (4) are encircled by the housing (2), a central electrical contact (5) for transmitting an electrical signal is concentrically encircled by the insulative body (4), and an electrical terminal portion (33) of the contact (5) projects from the shell (2), and an extended axial stem portion (21) of the insulative body (21) projects outwardly from the conductive housing (2) and encircles the terminal portion (33) to provide a lengthy voltage creepage path and a lengthy voltage clearance path.

6 Claims, 2 Drawing Sheets

HIGH VOLTAGE COAXIAL CONNECTOR

This application is a continuation of Application Ser. No. 180,413 filed Apr. 12, 1988, now abandoned.

FIELD OF THE INVENTION

The specification relates to the field of electrical coaxial connectors for transmitting high voltage radio frequency signals and particularly for coupling a shielded high voltage signal to a printed circuit board, PCB.

BACKGROUND OF THE INVENTION

There is disclosed in U.S. Pat. No. 4,659,156 a known coaxial connector in which a conductive housing is provided with a projecting electrical terminal, a conductive shell and an insulative body are encircled by the housing, a central electrical contact for transmitting an electrical signal is concentrically encircled by the insulative body, and an electrical terminal portion of the contact is encircled by a portion of the insulative body that projects outwardly from the shell.

In the known connector, the housing encircles the portion of the insulative body that projects from the shell. A clearance separates the housing from the electrical contact. In a construction wherein the housing is conductive, the length of the clearance defines a clearance path for an electrical short of a high voltage signal.

Further in the known connector, a voltage creepage path extends along an exterior surface of the dielectric body, from the terminal portion of the contact to the nearest surface of the shell. An electrical short might occur of a high voltage signal along the creepage path, from the electrical contact to the shell.

SUMMARY OF THE INVENTION

The connector according to the present invention is a coaxial connector that includes an electrical terminal portion of an electrical contact that projects outwardly from a conductive housing, and an extended axial stem portion of an insulative body that projects outwardly from the conductive housing and encircles the terminal portion to provide a lengthy voltage creepage path and a lengthy clearance path to prevent an electrical short of a high voltage signal.

Known coaxial connectors for high voltage radio frequency signals, also called RF signals, are only practicable when assembled directly to electrical coaxial cables, and are not suitable for assembly with a PCB, and particularly are not suited for close together mounting on a PCB to limit consumption of surface area on the PCB.

According to the present invention, a conductive housing of the connector defined in this specification radially supports the insulative body and is locked directly to the insulative body and to the conductive shell to provide a simplified construction, and is of a width extending radially of the insulative body to allow close spacing of the housing with another such housing on a PCB, and to provide for adequate voltage creepage and clearance paths along each of the connectors and between the connectors on the PCB.

Known coaxial connectors for mounting on a PCB are unsuitable for transmitting high voltage RF signals, and are constructed with a desired electrical impedance for transmitting RF signals, but are constructed without regard to prevent an electrical short of high voltage RF signals.

The invention and its further advantages are apparent by way of example from the following description with reference to the drawings.

Figures 1, 2:
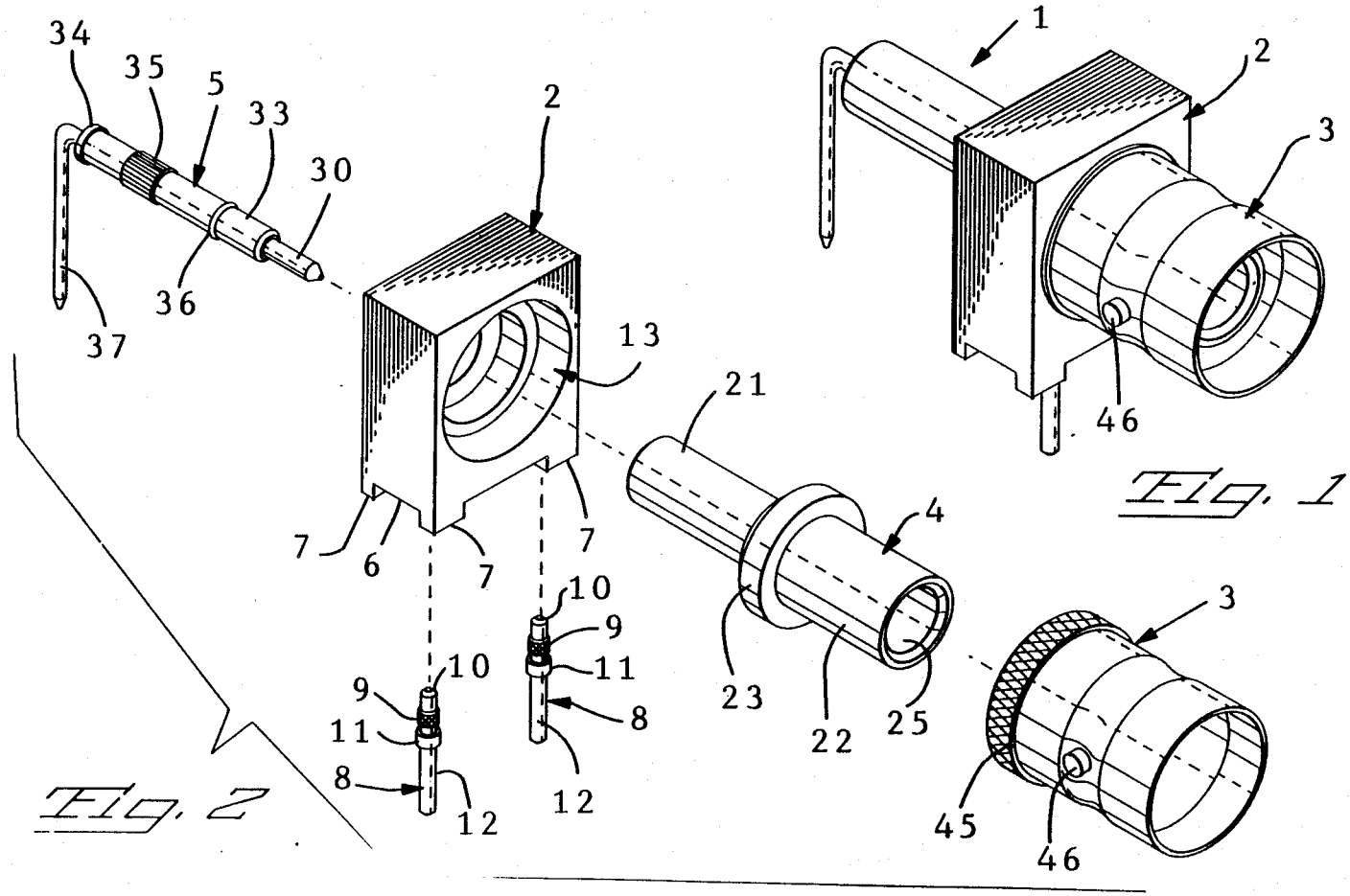
FIG. 1 is perspective view of a coaxial connector.
FIG. 2 is a perspective view of the connector shown in FIG. 1 with parts in exploded configuration to illustrate the details thereof.

With more particular reference to the drawings, there is shown an electrical coaxial connector 1 including a conductive housing 2, a conductive shell 3, a one piece insulative body 4 and a conductive electrical contact 5.

The housing 2 is a unitary polygonal block of metal with a flat bottom wall 6 for mounting against a PCB, not shown. Projecting legs 7 extend from the bottom wall 6 provides a clearance between the PCB and a large undersurface area of the housing 2. The bottom wall 6 of the housing 2 is provided with a corresponding recess, not shown, that receives a corresponding elongated conductive electrical terminal 8 with an interference fit.

The corresponding terminal 8 is of unitary construction and includes a radially enlarged section 9 with a knurled circumference adjacent a first end 10. The knurled circumference establishes an interference fit within the corresponding recess of the housing 2 to establish an electrical connection. A radially enlarged collar 11 adjacent the enlarged section engages against the bottom wall 6 to stop the terminal 8 in a desired position with respect to the housing 2. An opposite end 12 of the corresponding terminal 8 projects from the housing 2 for connection in an aperture of the PCB, for example, by soldering or by friction fit in the aperture, according to established practice.

The housing 2 includes a stepped diameter bore 13 including, a reduced diameter portion 14 extending through a rear wall 15, a first enlarged diameter portion 16 defining a radially extending first shoulder 17 at an intersection with the reduced diameter portion 14, and a second enlarged diameter portion 18 extending through a front wall 19 of the housing 2 and further defining a radially extending second shoulder 20 at an intersection with the first enlarged diameter portion 16. An interior angle of the first shoulder 17 is provided with a bevel surface **17*a***.

The insulative body 4 is of unitary construction with an elongated axial stem portion 21 of reduced diameter and an axially elongated front portion 22 of enlarged diameter. An external and radially projecting flange 23 is between the stem portion 21 and the front portion 22. A rear corner edge of the flange has a chamfer 24. An axial cavity or passage 25 with a reduced diameter portion 26 extends through the stem portion 21. An enlarged diameter portion 27 of the passage 25 extends axially along the front portion 22 and intersects the reduced diameter portion 26 at a radially extending shoulder 28. The front end 29 of the passage is outwardly flared.

The electrical contact 5 is of unitary elongated construction with a reduced diameter front end providing an electrical plug portion 30 for disengaged connection with the interior of an electrical receptacle type contact 31 of a complementary mating connector 32. The plug portion 30 extends axially from an elongated terminal portion 33 having a rear flange 34 that projects outward radially. The enlarged diameter portion 33 is elongated axially and provided with a radially projecting external collar 35 having a cylindrical knurled surface, and with an external annular barb 36 inclined toward a rear of the contact 5. An end portion 37 extends from the rear of the flange 34 and is formed to project at an angle and transversely of the axis of the plug portion 30.

The contact 5 is assembled with the stem portion 21 of the insulative body 4 by movement of the contact 5 along the stem portion 21 until the flange 34 of the contact engages a rear end 38 of the stem portion 21. The barb 36 is in interference fit with and imbeds in the insulative body 4 to prevent withdrawal of the contact 5 toward the rear 38 of the stem portion 21. The collar 35 of the contact 5 is joined to the insulative body 4 by the application of heat, causing the insulative body 4 to flow into interlocked engagement with the knurled surface 35, according to a procedure disclosed in U.S. Pat. No. 4,712,296.

The insulative body 4 is assembled in the bore 13 of the housing 2 with the stem portion 21 projecting through the rear wall 15, and with the rear end of the flange 23 engaged against the first shoulder 17, and with the chamfer 17*a* facing and closely adjacent to the chamfer 24. The end portion 37 of the terminal portion 33 extends in the same direction as each corresponding terminal 8 for insertion into a corresponding aperture of the PCB.

Figure 3:
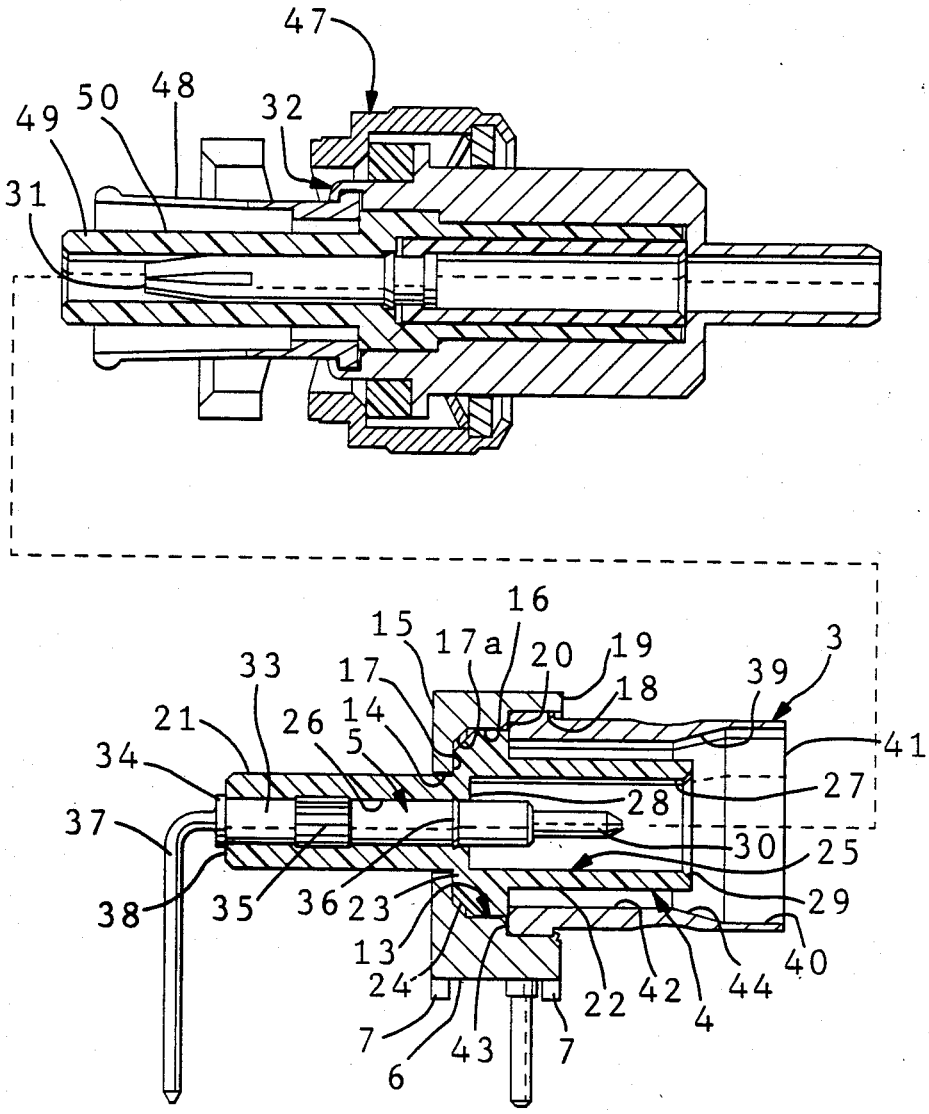
FIG. 3 is an elevation view in section of the connector shown in FIG. 1, and further illustrating a section of a complementary connector.

The shell 3 is of unitary hollow construction with an interior surface 39 encircling an enlarged internal diameter 40 through a front end 41 and a reduced internal diameter 42 through a rear end 43. A tapered portion 44 of the interior surface 39 extends from one diameter to the other diameter. A radially projecting external collar 45 at the rear end of the shell 3 has a knurled cylindrical surface. The shell 3 has a cylindrical exterior extending from the collar and is provided with projecting prongs, one shown at 46 of a bayonet coupling for disengaged connection to a slotted bayonet coupling ring 47 of the complimentary mating connector 37 shown in FIG. 3. The shell 3 is assembled with the housing 2 by movement axially along the bore 13 of the housing 2 until the rear end 45 of the shell 3 engages the second shoulder 20. The housing 2 encircles the knurled surface of the collar 45 with an interference fit to retain the shell 3 within the housing 2 and to provide an electrical connection of the housing 2 and the shell 3. The collar 45 radially overlaps the flange 23 of the insulative body 4 to retain the body 4 in axial position between the shell 3 and the first shoulder 17 of the housing 2. Thereby, the housing 2 is directly locked to the insulative body 4 and the shell 3.

The axial stem portion 21 of the insulative body 4 is uncovered and projects substantially outwardly from the conductive housing 2 and encircles the terminal portion 33 to provide a lengthy voltage creepage path extending along the insulative body 4 from the contact 5 to the housing 2, and a lengthy clearance path in a space extending from the contact 5 to the housing 2, to prevent an electrical short of a high voltage RF signal from the contact 5 to the housing 2. The stem portion 21 projects from the housing 2 and is unsupported along its length. In the connector capable of transmitting an RF signal of 2500 volts, the housing 2 is 0.355 inches wide and 0.435 in elevation. The axis of the stem portion 21 is 0.250 inches elevation and is centrally of the width of the housing 2. The width of the housing 2 extends substantially outward laterally side to side from the stem portion 21 to provide adequate creepage and clearance paths from the contact 5 to another like housing, not shown, of another connector 1 on the PCB. The small size of the housing 2 is suitable for limiting consumption of surface area of the PCB and for close together mounting with another like housing 2 on the PCB.

In the connector 1, the front end 30 of the contact 5 is recessed within the front portion 29 of the insulative body 4. The cavity 25 provides a radial clearance between the contact 5 and the insulative body 4. A further radial clearance is provided between the front portion 29 of the insulative body 4 and the shell 3. Thereby, adequate creepage and clearance paths are provided to prevent an electrical short of a high voltage RF signal from the contact 5 to the shell 2, either across such clearances or along the surface of the insulative body 4.

Upon complementary mating of the connector 1 with the complementary connector 32, a conductive shell 48 of the complementary connector 32 will be received in the shell 3. The likelihood of an electrical short from the contact 5 to the conductive shell 48 is prevented, since a front portion 49 of an annular insulative member 50 of the complementary connector 32 is received radially over the contact 5, thereby increasing the clearance path and the creepage path from the contact 5 to the shell 48 of the complementary connector 32.

We claim:

1. In a coaxial connector in which a conductive housing is provided with a projecting electrical terminal, a conductive shell and an insulative body are encircled by the housing, a central electrical contact for transmitting an electrical signal is concentrically encircled by the insulative body, and an electrical terminal portion of the contact is encircled by a portion of the insulative body that projects outwardly from the shell, a clearance separates the housing from the electrical contact and defines a clearance path for an electrical short of a high voltage signal, and a voltage creepage path extends along an exterior surface of the dielectric body, from the terminal portion of the contact to a nearest surface of the shell, the improvement comprising;

an extended axial stem portion of the insulative body is uncovered and projects substantially outwardly from the conductive housing in a space outwardly of the conductive housing, the terminal portion of the electrical contact projects outwardly from the conductive housing and in said space, the stem portion encircles the terminal portion to provide a lengthy voltage creepage path and a lengthy clearance path from the terminal portion to the housing to prevent an electrical short of a high voltage signal, the terminal portion protrudes uncovered from the stem portion and is bent to extend transversely of the stem portion and in the same direction as the projecting electrical terminal, the housing encircles the shell with an interference fit, and the shell and the insulative body are received in a bore of the housing, with the shell overlapping the insulative body and being encircled by the housing with an interference fit.

2. In a connector as recited in claim 1, the improvement further comprising;

the front end of the contact is recessed within the front portion of the insulative body, a radial cavity provides a clearance between the contact and the insulative body, and a further radial clearance is provided between the front portion of the insulative body and the shell.

3. In a connector as recited in claim 1, the improvement further comprising;

the conductive housing radially supports the insulative body and is locked directly to the insulative body and to the conductive shell.

4. A connector as recited in claim 1, the improvement further comprising;

the housing is polygonal and has a width and a height constructed to extend outwardly from the stem portion to allow close spacing of the housing with another such housing on a PCB, and to provide adequate voltage creepage and clearance path along the stem portion in said space.

5. In a connector as recited in claim 1, the improvement further comprising;

the housing is a polygonal block.

6. In a connector as recited in claim 1, the improvement further comprising;

the stem portion extends unsupported from a rear end wall of the housing.

* * * * *

UNITED STATES PATENT OFFICE

CERTIFICATE OF CORRECTION

Patent No. 4,904,206 Dated February 27, 1990

Inventor(s) Ronald C. Laudig, George W. Michael, III, Douglas M. Johnescu

It is certified that error appears in the above-identified patent and that said Letters Patent is hereby corrected as shown below:

Claim 4, column 6, line 5, the word "path" should be --paths--.

Signed and Sealed this

Eleventh Day of June, 1991

*Attest:*

*Attesting Officer*

HARRY F. MANBECK, JR.

*Commissioner of Patents and Trademarks*